United States Patent [19]

Thatcher

[11] 4,302,128

[45] Nov. 24, 1981

[54] ASPHALT SEALING MACHINE

[76] Inventor: Gary G. Thatcher, Rte. 1, Box 253, Van Wert, Ohio 45891

[21] Appl. No.: 80,826

[22] Filed: Oct. 1, 1979

[51] Int. Cl.[3] ..... E01C 19/15

[52] U.S. Cl. ..... 404/111; 222/624

[58] Field of Search ..... 404/110, 111, 108; 222/368, 414, 616, 623, 626

[56] References Cited

U.S. PATENT DOCUMENTS

| | | | |
|---|---|---|---|
| 1,712,549 | 5/1929 | Castellano | 404/110 |
| 2,508,195 | 5/1950 | Seaman | 222/624 X |
| 2,684,788 | 7/1954 | Bland | 222/623 |
| 2,904,224 | 9/1959 | Young | 222/624 X |
| 2,906,438 | 9/1959 | Carpenter | 222/368 X |
| 3,070,264 | 12/1962 | Christy | 222/368 X |
| 3,283,675 | 11/1966 | Gifford | 404/111 |
| 3,519,169 | 7/1970 | Holland | 222/626 |
| 3,533,336 | 10/1970 | Wikez | 404/111 |
| 3,703,856 | 11/1972 | Wikez | 404/111 |
| 3,940,213 | 2/1976 | Smith | 404/111 |

*Primary Examiner*—Nile C. Byers, Jr.
*Attorney, Agent, or Firm*—John L. Gray

[57] ABSTRACT

An asphalt sealing machine for applying a sealant coating to asphalt pavement either alone, or in combination with fine particulate matter, such as sand. The machine includes a body supported on three wheels with the front wheel being a steerable driven wheel. The body includes a storage tank for the liquid coating material. Support beams are pivotally connected to the rear of the body and extend rearwardly to support squeegees, a paddle wheel, and sand dispensing device. The sand dispensing device is driven by one of the rear wheels and is provided with a clutch so that the liquid asphalt coating material may be dispensed alone or in combination with the sand.

6 Claims, 4 Drawing Figures

ASPHALT SEALING MACHINE

SUMMARY OF THE INVENTION

This invention relates to a machine for applying a sealant coating to asphalt pavement. The sealant coating may either be applied alone, or as a mixture of liquid sealant and fine particulate matter, such as sand, in order to obtain a skid resistant surface.

In sealing asphalt pavements, such as driveways, parking lots, and the like, it is common practice to apply a liquid sealant material to the pre-moistened asphalt surface, uniformly spread the liquid sealant on the surface with a brush, and then squeegee the material to provide both a satisfactory penetration of the surface interstices and a uniform coating. In the case of driveways, oftentimes the sealant material is applied by hand with the sealant being dispensed from a container and the squeegee and brushes being manipulated by hand.

In larger areas it is much more efficient and economical to employ an asphalt sealing machine which may dispense the water and the sealant and which is equipped with a squeegee to provide an initial even spreading of the sealant, a paddle wheel for working the sealant into the pavement surface, and a squeegee to provide a final finish on the surface being sealed.

In some cases, the resulting surface is extremely smooth and slick and this can cause problems when the surface is wet, especially if the surface is inclined. A common practice in the case of hand applied sealant material is to mix fine sand in the liquid sealant container and then this mixture is poured on the driveway to be sealed and spread with a spreader or a squeegee so as to achieve a uniform distribution of liquid sealer and sand. When the material has dried, a slightly abrasive surface results having the consistency of a medium sandpaper and thus provides much greater safety and non-skid characteristics in use.

It is impractical to mix sand in the liquid sealant in an asphalt sealing machine since the liquid asphaltic material is dispensed through a series of valves and the presence of fine particulate matter in the liquid, such as sand, tends to clog up the valves, prevent them from closing properly, and in general creates severe maintenance problems.

Disposition of sand by broadcasting by hand or other means in advance of the asphalt sealing machine results in an uneven non-uniform distribution of the liquid sealant and sand mixture and also in some areas the liquid sealer fails to penetrate the surface prior to application of the sealant material.

The instant invention is directed to an asphalt sealing machine which is designed to avoid these objectionable results and to provide a finished sealed surface containing a uniform distribution of fine particulate material so that the surface has good, non-skid characteristics throughout.

An object of this invention, therefore, is to provide an asphalt sealing machine which is capable of evenly distributing a liquid asphalt sealant in combination with an even distribution of fine particulate matter.

Another object of this invention is to provide an asphalt sealing machine which may be utilized to apply liquid sealant material to an asphalt pavement surface without the addition of fine particulate matter.

A still further object of this invention is to provide an asphalt sealing machine which will distribute fine particulate material on the previously applied liquid asphalt sealing material only when the asphalt sealing machine is in motion.

These, together with other objects and advantages of the invention, will become apparent in the details of construction and operation as more fully described hereinafter and claimed, reference being had to the accompanying drawings forming a part hereof wherein like numerals refer to like parts throughout.

DETAILED DESCRIPTION OF THE INVENTION

Figure 1:
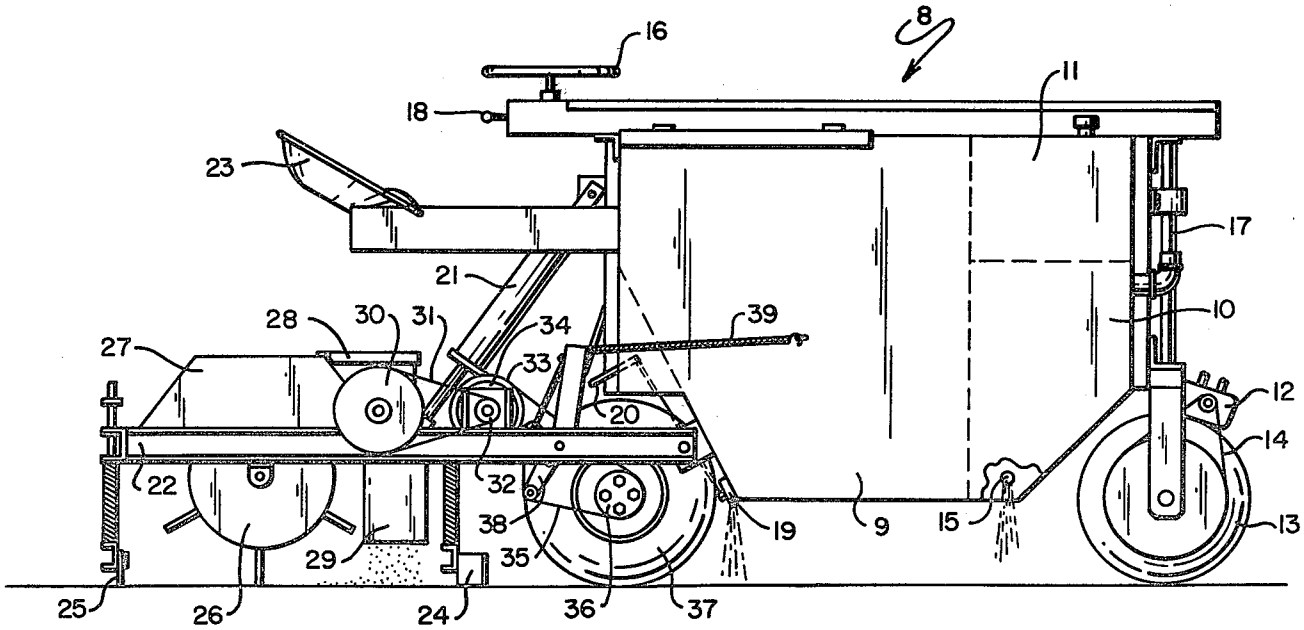
FIG. 1 is a side elevation view of applicant's asphalt sealing machine.

Referring now more particularly to the drawings and to FIG. 1, applicant's invention comprises an asphalt sealing machine containing a body shown generally at 8 which comprises a tank 9 for housing a liquid sealant material and a tank 10 which contains water. Tank 11 houses fuel for a drive motor (not shown) which provides the power to drive the hydraulic motor 12 which is used to drive the steerable single forward wheel 13 through appropriate chain and sprocket arrangement 14. Water from tank 10 is dispensed to the pavement by means of valve 15 controlled by a suitable linkage to the driver's control panel (not shown). The machine is also equipped with a steering wheel 16 which, through suitable chain and sprocket linkage (not shown) is connected to the shaft 17 supported by the steerable front wheel 13. Appropriate controls 18 for the operator to control the engine speed and hydraulic system are also provided. The liquid sealant material contained in tank 9 is dispensed through valve 19 which is controlled by foot pedal 20. A hydraulic cylinder 21 is provided to lift the entire assembly at the rear of the asphalt sealing machine supported on beams 22 for use in transporting the device in non-operating mode. An operator's seat 23 is provided, and supported on the beams 22 is an adjustable forward squeegee 24 and an adjustable rear squeegee 25 and a paddle wheel 26 which is operated by a suitable chain and sprocket linkage to either a hydraulic motor (not shown) or by direct connection to one of the rear wheels. If desired, an agitator (not shown) can be incorporated in tank 9, either driven from one of the rear wheels or from a hydraulic motor (not shown). A guard 27 is provided over the paddle wheel to protect the operator.

The fine particulate matter container 28 is located immediately forward of the paddle wheel and is provided with a dispenser shaft 29 and a drive sprocket wheel for uniform dispensing of the fine particulate matter. This sprocket wheel 30 is driven through a chain 31 by a sprocket wheel 32 which in turn is connected to a sprocket wheel 33 through an electric clutch 34. The sprocket wheel 33 is driven by a chain 35 connected to a sprocket wheel 36 mounted on the rear wheel 37 through a tension balancing device 38 which in turn is supported by a tension spring 39. This allows for variations in squeegee height, curvature of the surface being treated, and also for movement of the entire mechanism to a travelling mode when the hydraulic cylinder 21 is actuated.

Figure 2:
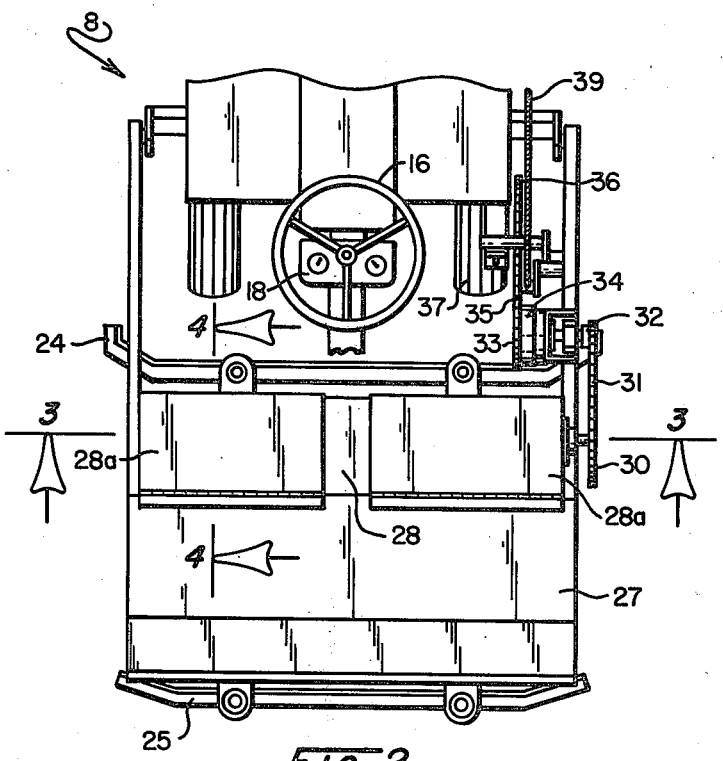
FIG. 2 is a plan view of the rear portion of applicant's sealing machine showing the fine particulate dispensing device and its drive mechanism.

Referring now more particularly to FIG. 2, it will be seen that the sand dispensing unit 28 is provided with hinged covers 28*a* to permit the loading of fine particulate matter such as sand and that the sprocket wheel 30 is connected by drive chain 31 to sprocket wheel 32 which in turn is connected to sprocket wheel 33 by clutch 34. Sprocket wheel 33 in turn, by means of chain 35, is connected to sprocket wheel 36 mounted on rear wheel 37.

Figure 3:
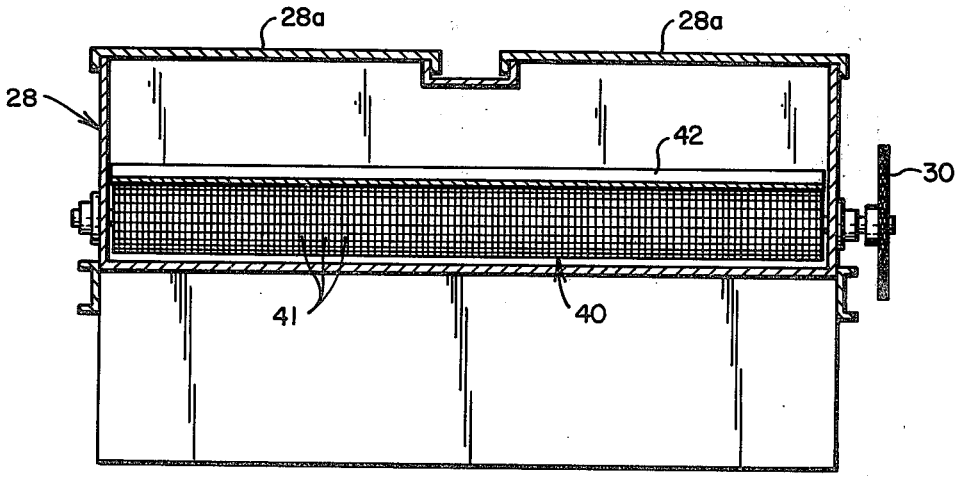
FIG. 3 is a vertical elevation view of the particulate dispensing device of applicant on the section line 3—3 of FIG. 2.

Referring now more particularly to FIG. 3, the sand dispensing unit includes a cylindrical dispenser 40 which is rotated by means of the pulley 30. This cylindrical dispenser 40 has a surface provided with a plurality of small cups 41, each of which is adapted to receive a quantity of sand or other fine particulate matter and each of which will contain the same amount of sand or other fine particulate matter because of the restrainer 42 which prevents additional sand or fine particulate matter from being dispensed. This is perhaps more effectively shown in FIG. 4.

Figure 4:
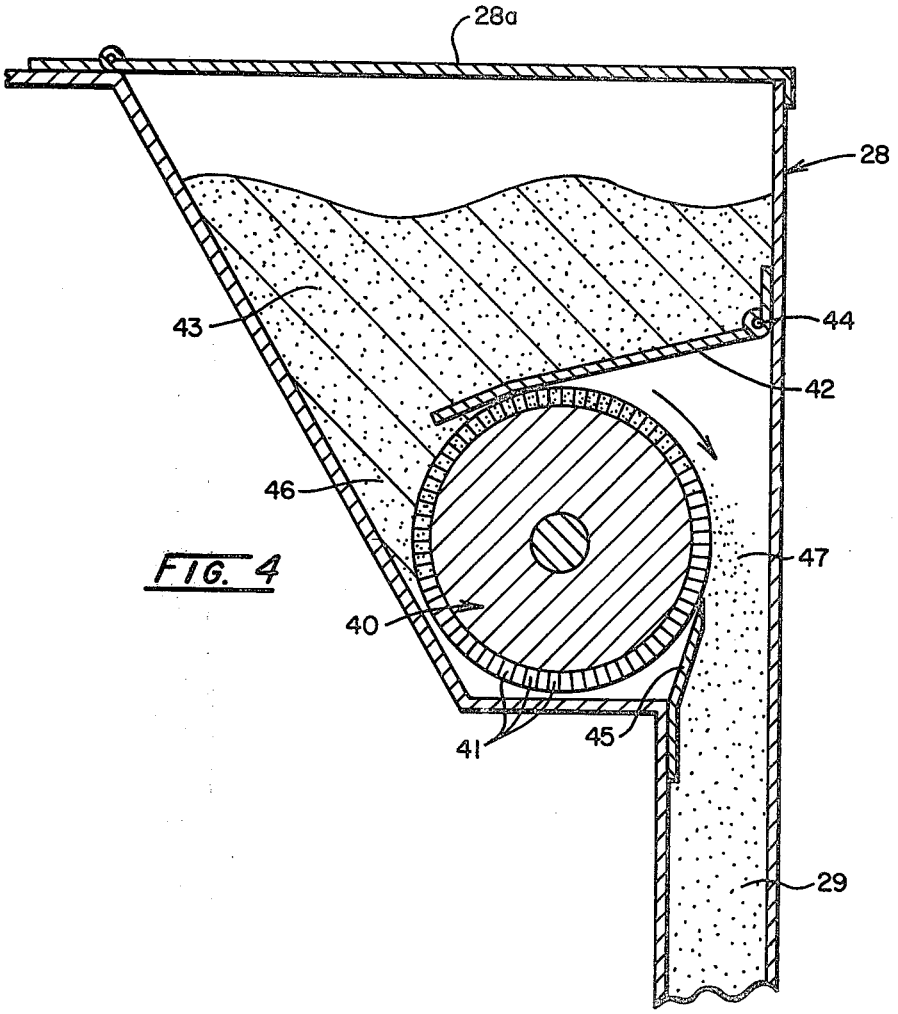
FIG. 4 is a side elevation view of the fine particulate dispensing unit on the section line 4—4 of FIG. 2.

Referring now more particularly to FIG. 4, the container 28 is shown filled with fine particulate matter 43, such as sand, which is prevented from falling down the shaft 29 by means of the restrainer 42 which is provided with a hinge 44 at the forward edge of the container 28.

An additional restrainer 45 is provided at the entrance to the shaft 29 which extends the length of the cylinder 40 as does the restrainer 42. The direction of rotation is shown as being clockwise.

Thus, in operation, with the clutch 34 engaged, and only when the asphalt sealing machine is moving forward, uniform quantities of sand are picked up in the cups 41 which cover the entire surface of the cylindrical dispenser 40 in the area of sand 43 shown at 46 and are transported to the zone 47 where they are dropped down the shaft 29 for uniform spreading on the liquid asphalt sealant material which has previously been laid down. The restrainer 42 provides the dual function of preventing the sand 43 from falling down the shaft 29 and also prevents the small individual cups 41 from being filled other than uniformly since it wipes off the top of the cups 41 so that each cup 41 has the same amount of sand therein. This enables uniform sand distribution to be achieved continuously across the entire width of the sealing machine.

Thus it will be seen that in operation the hydraulic cylinder 21 is actuated to lower the squeegees, paddle wheel and sand dispensing unit into operable position and as the asphalt sealing machine moves forward, water may or may not be dispensed through valve 15, liquid sealant may be dispensed through valve 19, and sand may be dispensed by means of the sand dispensing device 28 depending upon whether or not the clutch 34 is engaged. If the clutch is engaged, as long as the machine is moving forward, sand will be dispensed onto the previously dispensed liquid sealant material, which has been evenly spread by forward squeegee 24, the mixture will be uniformly mixed and the sand incorporated into the sealant by the paddle wheel 26 and a final finish on the surface being sealed will be achieved thereafter by the rear squeegee 25.

If desired, the paddle wheel 26 may be replaced with a third squeegee (not shown) to perform the same function of incorporating the sand into the sealant by the paddlewheel 26 prior to the final finish on the surface being performed by the rear squeegee 25.

While this invention has been described in its preferred embodiment, it is appreciated that variations thereon may be made without departing from the proper scope and spirit of the invention.

What is claimed is:

1. An asphalt sealing machine comprising body means including reservoir means for storing and distributing fluid, wheel means movably supporting said body means, support means pivotally supported on and extending from said body means, a container on said support means adapted to hold sand, said container housing a horizontally positioned rotatable cylindrical dispenser, the entire surface of said cylindrical dispenser being covered with a plurality of small cups, a horizontally disposed restrainer extending parallel to said cylindrical dispenser adjacent to the upper edges of said cups to insure that said cups have equal volumes of sand therein, said cylindrical dispenser only being rotatable when said asphalt sealing machine is in motion, spreader means supported by said support means and drive means on said support means for rotating said cylindrical dispenser, whereby a uniform quantity of sand is dispensed onto previously dispensed fluid and mixed therewith.

2. A machine as set forth in claim 1 wherein said drive means for actuating said rotatable cylindrical dispenser is driven from said wheel means.

3. A machine as set forth in claim 2 wherein said drive means for actuating said rotatable cylindrical dispenser is provided with means for disconnecting said drive means from said wheel means.

4. A machine as set forth in claim 3 wherein said drive means for actuating said rotatable cylindrical dispenser is connected to said wheel means by a combination of chains and sprockets and an automatic tension-holding means is attached to said chains.

5. A machine as set forth in claim 1 which is provided with means for uniformly spreading said fluid on said asphalt surface to be sealed after said fluid has been distributed on said surface.

6. A machine as set forth in claim 1 wherein said spreader means includes a spreader means rotatably supported by said support means and drive means for rotating said spreader means.

* * * * *